US009938470B2

(12) United States Patent
Yang et al.

(10) Patent No.: US 9,938,470 B2
(45) Date of Patent: Apr. 10, 2018

(54) MULTI-COMPONENT SCAVENGING SYSTEMS

(75) Inventors: Jianzhong Yang, Missouri City, TX (US); Bradley G. Harrell, Pearland, TX (US); Lawrence N. Kremer, The Woodlands, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 1187 days.

(21) Appl. No.: 13/468,697

(22) Filed: May 10, 2012

(65) Prior Publication Data

US 2013/0299734 A1 Nov. 14, 2013

(51) Int. Cl.
*C10G 29/22* (2006.01)
*C10G 29/24* (2006.01)

(52) U.S. Cl.
CPC ..... *C10G 29/24* (2013.01); *C10G 29/22* (2013.01); *C10G 2300/202* (2013.01)

(58) Field of Classification Search
CPC ... C10G 29/22; C10G 29/24; C10G 2300/202
USPC ..... 252/180
See application file for complete search history.

(56) References Cited

U.S. PATENT DOCUMENTS

| | | | | |
|---|---|---|---|---|
| 2,543,953 | A | 3/1951 | Backensto | |
| 2,571,666 | A | 10/1951 | Bond et al. | |
| 3,216,941 | A | 11/1965 | Devries | |
| 3,676,089 | A | 7/1972 | Morris et al. | |
| 3,819,328 | A | 6/1974 | Go | |
| 4,105,417 | A | 8/1978 | Coon et al. | |
| 4,402,708 | A | 9/1983 | Oswald | |
| 4,439,553 | A | 3/1984 | Guthrie et al. | |
| 4,448,586 | A | 5/1984 | Weidig | |
| 4,531,948 | A | 7/1985 | Knapp | |
| 4,618,411 | A | 10/1986 | Dickakian | |
| 4,802,973 | A * | 2/1989 | Hodgson et al. | 208/207 |
| 4,927,519 | A | 5/1990 | Forester | |
| 5,114,566 | A | 5/1992 | Naeger et al. | |
| 5,223,127 | A | 6/1993 | Weers et al. | |
| 5,254,138 | A | 10/1993 | Kurek | |
| 5,266,186 | A | 11/1993 | Kaplan | |
| 5,556,575 | A | 9/1996 | Babaian-Kibala et al. | |
| 5,698,696 | A | 12/1997 | Marciniak et al. | |
| 5,885,487 | A | 3/1999 | Minevski | |
| 6,063,873 | A | 5/2000 | Lawson et al. | |
| 6,284,008 | B1 | 9/2001 | Caprotti | |
| 6,441,264 | B1 | 8/2002 | Lemaire et al. | |
| 8,058,493 | B2 | 11/2011 | Stark et al. | |
| 2002/0068034 | A1 * | 6/2002 | Schield | C01B 17/0232 423/563 |
| 2004/0045875 | A1 | 3/2004 | Nguyen et al. | |
| 2007/0205140 | A1 * | 9/2007 | Shibata | B01D 53/1468 208/208 R |
| 2009/0095658 | A1 * | 4/2009 | Yang | C07C 291/02 208/236 |
| 2009/0283449 | A1 * | 11/2009 | Subramaniyam | C10G 17/04 208/252 |
| 2011/0315921 | A1 * | 12/2011 | Ramachandran et al. | 252/184 |

FOREIGN PATENT DOCUMENTS

| | | | |
|---|---|---|---|
| GB | 2079784 | A | 1/1982 |
| JP | 136239 | A | 5/1995 |
| WO | 2004106468 | A1 | 12/2004 |
| WO | 2005097300 | A1 | 10/2005 |

OTHER PUBLICATIONS

Meguerian, G.H., Organic and Biological Chemistry, "A Kinetic Study of the Oxidation of Mercaptans Catalyzed by Hydroquinone and its Homologs," Jnl of American Chemical Society, vol. 77, pp. 5019-5022 (Oct. 5, 1955).

* cited by examiner

*Primary Examiner* — Ling Siu Choi
*Assistant Examiner* — Thuy-Al N Nguyen
(74) *Attorney, Agent, or Firm* — Mossman, Kumar, & Tyler, P.C.

(57) ABSTRACT

A multi-component scavenging system containing at least one ester and at least one electron-deficient organic compound, together with or without one or more optional components such as an aldehyde having from 4 to 20 carbon atoms, a ketone having from 4 to 20 carbon atoms, an ether, a solvent, an alkali metal salt of an alkyl or dialkyl phenol, an epoxide, an alkyl anhydride, and mixtures thereof, may be used to scavenge contaminants from hydrocarbon and/or aqueous streams. The contaminants scavenged or otherwise removed may include, but are not necessarily limited to, ammonia, primary amines, secondary or tertiary amines, $H_2S$, mercaptans, sulfide cyanides, and combinations thereof.

13 Claims, No Drawings

MULTI-COMPONENT SCAVENGING SYSTEMS

TECHNICAL FIELD

The present invention relates to methods and compositions for scavenging contaminants from hydrocarbon and/or aqueous streams, and more particularly relates, in one embodiment, to methods and compositions for scavenging ammonia, organic amines, $H_2S$, mercaptans, sulfides, and/or cyanides from streams using a multi-component scavenger system.

BACKGROUND

In the drilling, completions, production, transport, storage, and processing of crude oil and natural gas, including waste water associated with crude oil and gas production, and in the storage of residual fuel oil, contaminants are often encountered. Such contaminants may include, but are not necessarily limited to, ammonia, primary, secondary and tertiary amines, hydrogen sulfide ($H_2S$), mercaptans, sulfides, and/or cyanides. Under suitable conditions, ammonia and organic amines tend to combine with hydrogen halides to form corrosive deposits on the internal surfaces of refinery units, especially in the overhead system, which can lead to serious operation failure due to the acidic nature of these deposits. Such failure can be disastrous, with consequences that may include not only the loss of production, but also the loss of life. Thus, properly managing these deposits is important. Further, the presence of $H_2S$ and mercaptans is extremely objectionable because they are an acute health hazard and often highly corrosive. Still another reason that mercaptans are undesirable is that they have highly noxious odors. The odors resulting from mercaptans are detectable by the human nose at comparatively low concentrations and are well known. For example, mercaptans are used to odorize natural gas and used as a repellant by skunks and other animals.

Further, other of these contaminants in hydrocarbon and/or water systems may cause various health, safety and environmental (HSE) concerns and/or corrosion issues during the production, storage, transportation and processing of oil and gas.

To eliminate these contaminants and potentially harmful species, various scavenger systems have been developed in the art. However, many of these systems have limitations, including, but not necessarily limited to, low reactivity and therefore low efficiency, containing atypical components or elements that may adversely affect fuel or fluid quality, or may present toxicity concerns themselves and/or as the consequent reaction products.

It would be desirable if methods and/or compositions could be devised that would remove, reduce, eliminate, take out or otherwise remove such contaminants from these hydrocarbon and/or aqueous streams, as well as reduce, alleviate or eliminate corrosion caused by these undesired contaminants.

SUMMARY

There is provided a method for at least partially removing a contaminant from a stream, where the method involves contacting the contaminant in the stream with a multi-component scavenger in an amount effective to at least partially remove the contaminant from the stream. The multi-component scavenger may include at least one ester, and at least one electron-deficient organic compound. Contacting the contaminant with the at least one ester and the at least one electron-deficient organic compound may occur together or separately. The contaminants may include, but are not necessarily limited to, ammonia, organic amines, $H_2S$, mercaptans, sulfides and/or cyanides.

Additionally there is provided a multi-component scavenger which comprises at least one ester, at least one electron-deficient organic compound, and at least one additional component selected from the group consisting of an aldehyde having from 4 to 20 carbon atoms, a ketone having from 4 to 20 carbon atoms, an ether, a solvent, an alkali metal salt of an alkyl or dialkyl phenol, an epoxide, an alkyl anhydride, and mixtures thereof.

There is also provided, in another non-restrictive version, a treated stream having a base component selected from the group consisting of a hydrocarbon, water and mixtures thereof; a contaminant; and a multi-component scavenger in an amount effective to at least partially remove the contaminant from the stream, where the multi-component scavenger comprises at least one ester, and at least one electron-deficient organic compound.

DETAILED DESCRIPTION

It has been discovered that a multi-component scavenger or multi-component scavenger system reacts with or "scavenges" or otherwise removes, ammonia, tramp amines such as primary amines, secondary amines or tertiary amines (also collectively called "organic amines" herein), $H_2S$ mercaptans, sulfides, cyanides, or residual amines (also included in the term "organic amines" herein) from hydrocarbon streams, such as crude oil streams or other hydrocarbon streams where these contaminants may be present from any source. Many of these contaminants may over time and/or under certain conditions contact other reactants and form undesirable corrosive products.

In one non-limiting instance, organic amines and/or ammonia are frequently present in the desalted crude oil as contaminants from upstream treatment, via desalter wash water or from introduction of slop oils. These basic compounds can, under certain conditions, react with HCl and other acids to form corrosive salts. The conditions in crude distillation towers often favor these reactions. The fouling and corrosion that results from the formation of the salts increases the refinery operating and maintenance costs significantly. Efforts to minimize or exclude the tramp bases, amines or ammonia from the unit feed streams are often ineffective or economically infeasible. Consequently, there is a need for another means of removing these bases from the desalted crude and other such streams like spent caustic for health and environmental concern. The multi-component scavenger system and method described herein is one such approach. It will be appreciated that in the context herein, the term "scavenger" encompasses a combination of components or additives, whether added to a stream separately or together, that scavenge one or more of the contaminants noted.

Additive chemistry has been found to react with and "remove" these contaminants, that is, form a less-objectionable reaction product which may still remain in the stream but does not have the undesirable effects of the contaminant per se. For instance, the action of the multi-component scavenger on the contaminants effectively at least partially converts them into thermally stable higher molecular weight compounds.

It has been discovered that there are a number of components that are effective in reacting with these contaminants to produce compounds or products that will no longer cause difficulty or concerns, or at least are less objectionable than the contaminants per se. It should be understood that the process is not technically "removing" the contaminant. The contaminant is converted into a product that will prevent it from presenting more concerns and problems than the original contaminant. The reaction between the multi-component scavenger and the contaminant will form a thermally stable product that does not cause or present such serious concerns or problems.

In one non-limiting embodiment, the multi-component scavenger contains at least one ester and at least one electron-deficient organic compound. These components may be added to the treated stream separately in any order or together as a combination or "package" or blend. It is expected that in most cases the components will be added as a package for convenience. More specifically suitable esters may include, but are not necessarily limited to, dialkyl malonate, dialkyl succinate, trialkyl citrate, ethylene carbonate, diethyl carbonate, ethyl acetoacetate, propylene carbonate, butylene carbonate, lactones and mixtures thereof. Suitable electron-deficient organic compounds may include, but are not necessarily limited to, acrylic esters, such as pentaerythritol triacrylate, pentaerythritol tetraacrylate, trimethylolpropane triacrylate, poly(ethylene glycol) diacrylate, 2-ethylhexyl acrylate, etc; dialkyl maleates, di-oxyalkylated maleates, benzoquinones, alkyl substituted quinones, and mixtures thereof. The electron-deficient organic compound may have at least one unsaturated double bond. Suitable electron-deficient organic compounds may include the multifunctional scavengers described in U.S. Patent Application Publication No. 2009/0095658 which is incorporated herein by reference in its entirety.

Within the multi-component scavenger the at least one ester may be present in a proportion ranging from about 1 independently to about 99 wt % and the at least one electron-deficient organic compound may be present in the multi-component scavenger in a proportion ranging from about 1 independently to about 99 wt %. The use of the term "independently" with respect to a range herein means that any lower threshold and any upper threshold may be combined to give an acceptable alternative range for that parameter. Alternatively, the proportions of each component may range from about 10 independently to about 60 wt %, and, conversely 60 independently to 10 wt %.

The multi-component scavenger may optionally contain at least one additional component selected from the group consisting of an aldehyde having from 4 to 20 carbon atoms, a ketone having from 4 to 20 carbon atoms, an ether, a solvent, an alkali metal salt of an alkyl or dialkyl phenol, an epoxide, an alkyl anhydride, and mixtures thereof. Suitable aldehydes may include but are not necessarily limited to benzaldehyde, citral, and the like and suitable ketones may include but are not necessarily limited to diacetyl, diketone, and the like. Suitable ethers may include but are not necessarily limited to crown ethers, diglyme, dibutyl ethylene glycol ether, and the like. Suitable solvents may include but are not necessarily limited to such as toluene, xylenes, Aromatic 100 solvent, and the like.

Suitable alkali metal salts of an alkyl or dialkyl phenol may include lithium, sodium or potassium salts. These salts may be oxyalkylated, e.g. ethoxylated and/or propoxylated. These salts may also include crown ethers and/or diglyme complexed with Li, Na, or K cation. Optional epoxides may include but are not necessarily limited to styrene oxides, glycidal ethers such as allyl glycidyl ether, bisphenol A diglycidyl ether, diglycidyl ether and the like. Optional alkyl anhydrides may include but are not necessarily limited to, maleic anhydride, succinic anhydride, phthalic anhydride and the like.

Suitable alternative proportion ranges for each of the optional components are shown in Table I. Percentages are weight percentage.

TABLE I

Proportions of Optional Components for the Scavenger System

| OPTIONAL COMPONENT | FIRST RANGE | SECOND RANGE |
|---|---|---|
| aldehyde | up to about 80% | up to about 50% |
| ketone | up to about 80% | up to about 50% |
| ether | up to about 80% | up to about 50% |
| an alkyl or dialkyl phenol alkali metal salt | up to about 50% | up to about 10% |
| epoxide | up to about 99% | up to about 50% |
| alkyl anhydride | up to about 99% | up to about 50% |
| solvent | up to about 80% | up to about 50% |

Typical application of the multi-component scavenger may involve the addition of between about 1 independently to about 10,000 ppm (by volume) of multi-component scavenger introduced or injected into the stream to be treated, in one non-restrictive version, but in another non-restrictive embodiment the amount of multi-component scavenger may range between about 10 independently to about 200 ppm. Alternatively, the addition of multi-component scavenger may be at a rate of up to about 10 times the amount of contaminant present in the stream, e.g. petroleum fluid or hydrocarbon stream; in another non-limiting embodiment, at a rate of up to about 5 times the amount of contaminant present. Testing indicates that there is typically sufficient time and temperature for the desired reaction to occur. In any event, sufficient time and/or conditions should be permitted so that the multi-component scavenger reacts with substantially all of the contaminant present. By "substantially all" is meant that no significant corrosion, odor and/or reactant problems occur due to the presence of the contaminant(s).

It will be understood that the complete elimination of corrosion, odor or other problems or complete removal of the contaminants is not required for successful practice of the method. All that is necessary for the method to be considered successful is for the treated hydrocarbon and/or aqueous stream to have reduced amounts of the contaminants as compared to an otherwise identical hydrocarbon and/or aqueous stream having no multi-component scavenger, and/or a reduced corrosion capability as compared to an otherwise identical hydrocarbon and/or aqueous stream having an absence of multi-component scavenger. Of course, complete removal of a contaminant is acceptable.

The invention will now be described with respect to particular Examples that are not intended to limit the invention but simply to illustrate it further in various non-limiting embodiments. Unless otherwise noted, all percentages (%) are weight %, and all dosages and amine levels are ppm by volume.

Examples 1-6

A sample of Aromatic 100 solvent having 1% water and a known amount monoethanol amine (MEA) recorded in the blank row of Table II (Example 1) as ppm MEA is treated with various candidates, as indicated. The sample is dosed with the various candidates and heated at 150° C. The amine level in each sample was examined by ion chromatography. The results are shown below in Table II, indicating considerable MEA reduction with each candidate.

TABLE II

Monoethanol Amine Scavenging

| Ex. | Additive | Dosage (ppm) | MEA Level (ppm) | % MEA reduction |
|---|---|---|---|---|
| 1 | Blank | — | 15 | — |
| 2 | Bisphenol A diglycidyl ether (EPON ® 828) | 500 | 0 | 100 |
| 3 | Bisphenol A diglycidyl ether (EPON ® 828) | 500 | 0.3 | 98 |
| 4 | Propylene Carbonate | 500 | 0.5 | 97 |
| 5 | Diethyl maleate | 600 | 0.1 | 99 |
| 6 | Dodecyl succinic anhydride | 500 | 0.5 | 98 |

Examples A-C

Multi-component compositions that expected to be useful herein include, but are not necessarily limited to the following outlined in Table III:

TABLE III

Multi-Component Compositions

| Examples compositions | Propylene carbonate (g) | Diethyl Maleate (g) | Benzoquinone (g) | Benzaldehyde (g) | Aromatic 100 (g) |
|---|---|---|---|---|---|
| A | 3.0 | 4.0 | 1.0 | — | 2.0 |
| B | 5.0 | 1.5 | 1.50 | 1.0 | 1.0 |
| C | 5.7 | — | 1.5 | — | 2.8 |

Examples 7-13

A sample of Aromatic 100 solvent having 1% diglyme and a known amount monoethanol amine (MEA) recorded in the blank row (Example 7) of Table IV as ppm MEA is treated with various candidates. The sample is dosed with the various candidates and heated at 150° C. The amine level in each sample was examined by ion chromatography. The results are shown below in Table IV, indicating considerable MEA reduction with each candidate and particularly with the multi-component scavengers of Examples B and C.

TABLE IV

Monoethanol Amine Scavenging

| Ex. | Additive | Dosage (ppm) | MEA Level (ppm) | % MEA reduction |
|---|---|---|---|---|
| 7 | Blank | — | 120 | — |
| 8 | Bisphenol A diglycidyl ether (EPON ® 828) | 500 | 53 | 56 |
| 9 | Propylene Carbonate | 500 | 73 | 39 |
| 10 | Diethyl maleate | 600 | 87 | 27 |
| 11 | Dodecyl succinic anhydride | 500 | 13 | 89 |
| 12 | Ex. B | 1000 | 13 | 89 |
| 13 | Ex. C | 1000 | 20 | 83 |

Examples 14-18

A sample of desalted crude oil and a known amount monoethanol amine (MEA) recorded in the blank row (Ex. 14) of Table V as ppm MEA is treated with various candidates. The sample is dosed with the respective candidates and heated at 300° F. (149° C.). The amine level in each sample was examined by ion chromatography. The results are shown below in Table V, indicating considerable MEA reduction with each candidate and particularly with the multi-component scavenger of Example C.

TABLE V

Monoethanol Amine Scavenging

| Ex. | Additive | Dosage (ppm) | MEA Level (ppm) | % MEA reduction |
|---|---|---|---|---|
| 14 | Blank | — | 12.4 | — |
| 15 | Propylene Carbonate | 500 | 1.3 | 90 |
| 16 | Diethyl maleate | 600 | 2.2 | 82 |
| 17 | Dodecyl succinic anhydride | 500 | 0.4 | 97 |
| 18 | Ex. C | 1000 | 0.4 | 97 |

Examples 19-23

A sample of desalted crude oil and a known amount monoethanol amine (MEA) recorded in the blank row (Example 19) of Table VI as ppm MEA is treated with various candidates. The sample is dosed with the respective candidates and heated in a high temperature bomb reactor at 500° F. (260° C.). The amine level in each sample was examined by ion chromatography. The results are shown below in Table VI, indicating considerable MEA reduction with each candidate and particularly with the multi-component scavenger of Example C.

TABLE VI

Monoethanol Amine Scavenging

| Ex. | Additive | Dosage (ppm) | MEA Level (ppm) | % MEA reduction |
|---|---|---|---|---|
| 19 | Blank | — | 22 | — |
| 20 | Propylene Carbonate | 500 | 34 | 0 |
| 21 | Diethyl maleate | 600 | 21 | 5 |
| 22 | Dodecyl succinic anhydride | 500 | 6 | 73 |
| 23 | Ex. C | 1000 | 2 | 91 |

Examples 24-26

A sample of desalted crude oil and a known amount monoethanol amine (MEA) recorded in the blank row of Table VII as ppm MEA is treated with various candidates. The sample is dosed with the respective candidates and passed through a high temperature Alcor Hot Liquid Process Simulator (HLPS) test apparatus at a rate of 2 ml/min and a temperature of 700° F. (371° C.). The amine level in each sample was examined by ion chromatography. The results are shown below in Table VII, indicating considerable MEA reduction with each candidate and particularly with the multi-component scavenger of Example C.

TABLE VII

| Monoethanol Amine Scavenging | | | | |
|---|---|---|---|---|
| Ex. | Additive | Dosage (ppm) | MEA Level (ppm) | % MEA reduction |
| 24 | Blank | — | 22 | — |
| 25 | Dodecyl succinic anhydride | 500 | 14 | 36 |
| 26 | Example C | 1000 | 1 | 95 |

Examples 27-35

A sample of Aromatic 100 having 1% diglyme and known amounts of monoethanol amine (MEA) and ethylene diamine (EDA) recorded in the blank row (Example 27) of Table VIII as ppm MEA and ppm EDA was treated with various candidates, as indicated. The stock amine samples were dosed with the various candidates and heated at 150° C. The amine level in each sample was examined by ion chromatography. The results are listed below in Table VIII. Example 32 particularly indicates multi-component scavenging of MEA and especially EDA.

TABLE VIII

| Monoethanol Amine (MEA) and Ethylene Diamine (EDA) Scavenging | | | | |
|---|---|---|---|---|
| Ex. | Additive | Dosage (ppm) | MEA (ppm) | EDA (ppm) |
| 27 | Blank | — | 45 | 2 |
| 28 | Dimethyl maleate | 600 | 36 | 2 |
| 29 | Diethyl malonate | 600 | 44 | 2 |
| 30 | Citral | 600 | 33 | 0.2 |
| 31 | Glyoxal | 1000 | 4 | 0 |
| 32 | Citral/dimethyl maleate/propylene carbonate (1:1:1 v/v/v) | 600 | 40 | 0.6 |
| 33 | Ex. C | 600 | 17 | 0 |
| 34 | Styrene oxide | 600 | 42 | 2 |
| 35 | Trimethylol propane triacrylate | 600 | 24 | 0.2 |

In the foregoing specification, the invention has been described with reference to specific embodiments thereof. The multi-component scavenger or scavenger system of this method would be expected to be useful in other hydrocarbon and/or aqueous steam processing operations besides those explicitly mentioned. It will be evident that various modifications and changes can be made to the methods and compositions described herein without departing from the broader spirit or scope of the invention as set forth in the appended claims. Accordingly, the specification is to be regarded in an illustrative rather than a restrictive sense. For example, specific multi-component scavenger components, proportions thereof, streams, and contaminants falling within the claimed parameters, but not specifically identified or tried in particular compositions, are anticipated and expected to be within the scope of this invention.

The present invention may suitably comprise, consist or consist essentially of the elements disclosed and may be practiced in the absence of an element not disclosed. For instance, the method of at least partially removing a contaminant from a stream may consist of or consist essentially contacting the contaminant in the stream with a multi-component scavenger in an amount effective to at least partially remove the contaminant from the stream, where the multi-component scavenger consists of or consists essentially of at least one ester, and at least one electron-deficient organic compound, where contacting the contaminant with the at least one ester and the at least one electron-deficient organic compound may occur together or separately.

Further, the multi-component scavenger may consist of or consist essentially of at least one ester, at least one electron-deficient organic compound, and at least one additional component selected from the group consisting of an aldehyde having from 4 to 20 carbon atoms, a ketone having from 4 to 20 carbon atoms, an ether, an alkali metal salt of an alkyl or dialkyl phenol, an epoxide, an alkyl anhydride, and mixtures thereof.

Additionally, a treated stream may consist of or consist essentially of a base component selected from the group consisting of a hydrocarbon, water and mixtures thereof; a contaminant; and a multi-component scavenger in an amount effective to at least partially remove the contaminant from the stream, where the multi-component scavenger consists of or consists essentially of at least one ester, and at least one electron-deficient organic compound.

The words "comprising" and "comprises" as used throughout the claims, are to be interpreted to mean "including but not limited to" and "includes but not limited to", respectively.

What is claimed is:

1. A method for at least partially removing a contaminant from a stream, the method comprising:

contacting the contaminant in the stream with a multi-component scavenger in an amount of from about 1 to 10,000 ppm by volume based on the stream to at least partially remove the contaminant from the stream, where the contaminant is selected from the group consisting of hydrogen sulfide, mercaptans, ammonia, organic amines, cyanides, and combinations thereof, and where the multi-component scavenger comprises:

at least one ester selected from the group consisting of dialkyl malonate, trialkyl citrate, ethylene carbonate, diethyl carbonate, ethyl acetoacetate, butylene carbonate, and mixtures thereof, and at least one electron-deficient organic compound; where contacting the contaminant with the at least one ester and the at least one electron-deficient organic compound may occur together or separately, and where the stream is selected from the group consisting of hydrocarbon streams, aqueous streams and combinations thereof.

2. The method of claim 1 where:

the electron-deficient organic compound is selected from the group consisting of acrylic esters, pentaerythritol tetraacrylate, dialkyl maleates, di-oxyalkylated maleates, benzoquinones, alkyl substituted quinones, and mixtures thereof.

3. The method of claim 1 where the at least one ester is present in the multi-component scavenger in a proportion ranging from about 1 to about 99 wt % and the at least one electron-deficient organic compound is present in the multi-component scavenger in a proportion ranging from about 1 to about 99 wt %.

4. The method of claim 1 where the multi-component scavenger comprises at least one additional component selected from the group consisting of an aldehyde having from 4 to 20 carbon atoms, a ketone having from 4 to 20 carbon atoms, an ether, an alkali metal salt of an alkyl or dialkyl phenol, an epoxide, and an alkyl anhydride.

5. The method of claim 4 where the at least one additional component is present in the following proportion, if present:

up to about 80 wt % of the aldehyde,
up to about 80 wt % of the ketone,
up to about 80 wt % of the ether,
up to about 50 wt % of the alkali metal salt of an alkyl or dialkyl phenol,
up to about 99 wt % of the epoxide, and
up to about 99 wt % of the alkyl anhydride.

6. A method for at least partially removing a contaminant from a stream selected from the group consisting of hydrocarbon streams, aqueous streams and combinations thereof, the method comprising:

contacting the contaminant in the stream with a multi-component scavenger in an amount effective to at least partially remove the contaminant from the stream, where the multi-component scavenger comprises:

from about 1 to about 99 wt % of at least one ester selected from the group consisting of dialkyl malonate, trialkyl citrate, ethylene carbonate, diethyl carbonate, ethyl acetoacetate, butylene carbonate, and mixtures thereof, and from about 1 to about 99 wt % of at least one electron-deficient organic compound selected from the group consisting of acrylic esters, pentaerythritol tetraacrylate, dialkyl maleates, di-oxyalkylated maleates, and mixtures thereof;

where contacting the contaminant with the at least one ester and the at least one electron-deficient organic compound may occur together or separately.

7. The method of claim 6, where the contaminant is selected from the group consisting of hydrogen sulfide, mercaptans, sulfides, and combinations thereof.

8. The method of claim 6 where the contaminant is selected from the group consisting of ammonia, organic amines, cyanides, and combinations thereof.

9. The method of claim 1 where the effective amount of the multi-component scavenger ranges from about 10 to about 200 ppm by volume based on the stream.

10. A method for at least partially removing a contaminant from a stream, the method comprising:

contacting the contaminant in the stream with a multi-component scavenger in an amount ranging from about 1 to about 10,000 ppm by volume based on the stream, where the multi-component scavenger comprises:

at least one ester selected from the group consisting of dialkyl malonate, trialkyl citrate, ethylene carbonate, diethyl carbonate, ethyl acetoacetate, butylene carbonate, and mixtures thereof, and at least one electron-deficient organic compound selected from the group consisting of acrylic esters, pentaerythritol tetraacrylate, dialkyl maleates, di-oxyalkylated maleates, and mixtures thereof;

where:

contacting the contaminant with the at least one ester and the at least one electron-deficient organic compound may occur together or separately, the contaminant is selected from the group consisting of hydrogen sulfide, mercaptans, ammonia, organic amines, cyanides, and combinations thereof, and the stream is selected from the group consisting of hydrocarbon streams, aqueous streams and combinations thereof.

11. The method of claim 10 where the at least one ester is present in the multi-component scavenger in a proportion ranging from about 1 to about 99 wt % and the at least one electron-deficient organic compound is present in the multi-component scavenger in a proportion ranging from about 1 to about 99 wt %.

12. The method of claim 10 where the multi-component scavenger comprises at least one additional component selected from the group consisting of an aldehyde having from 4 to 20 carbon atoms, a ketone having from 4 to 20 carbon atoms, an ether, an alkali metal salt of an alkyl or dialkyl phenol, an epoxide, and an alkyl anhydride.

13. The method of claim 12 where the at least one additional component is present in the following proportion, if present:

up to about 80 wt % of the aldehyde,
up to about 80 wt % of the ketone,
up to about 80 wt % of the ether,
up to about 50 wt % of the alkali metal salt of an alkyl or dialkyl phenol,
up to about 99 wt % of the epoxide, and
up to about 99 wt % of the alkyl anhydride.

* * * * *